US011377960B2

(12) United States Patent
Hiernaux

(10) Patent No.: US 11,377,960 B2
(45) Date of Patent: Jul. 5, 2022

(54) SHROUD HAVING ELEVATIONS, FOR A TURBOMACHINE COMPRESSOR

(71) Applicant: SAFRAN AERO BOOSTERS SA, Herstal (BE)

(72) Inventor: Stéphane Hiernaux, Oupeye (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 235 days.

(21) Appl. No.: 16/143,642

(22) Filed: Sep. 27, 2018

(65) Prior Publication Data

US 2019/0128121 A1 May 2, 2019

(30) Foreign Application Priority Data

Oct. 26, 2017 (BE) ..... 2017/5764

(51) Int. Cl.

| | |
|---|---|
| ***F01D 5/14*** | (2006.01) |
| ***F04D 29/54*** | (2006.01) |
| ***F04D 29/68*** | (2006.01) |
| ***F04D 29/32*** | (2006.01) |
| ***F01D 9/04*** | (2006.01) |

(52) U.S. Cl.

CPC ..... *F01D 5/143* (2013.01); *F01D 9/041* (2013.01); *F04D 29/321* (2013.01); *F04D 29/542* (2013.01); *F04D 29/681* (2013.01); *F05D 2240/121* (2013.01); *F05D 2240/122* (2013.01); *F05D 2240/123* (2013.01); *F05D 2240/124* (2013.01); *F05D 2250/71* (2013.01); *F05D 2250/711* (2013.01); *F05D 2250/712* (2013.01)

(58) Field of Classification Search

CPC ..... F01D 5/143; F01D 9/041; F04D 29/542; F04D 29/681; F04D 29/321; F05D 2240/121; F05D 2240/122; F05D 2240/123; F05D 2240/124; F05D 2250/71; F05D 2250/711; F05D 2250/712

USPC ..... 415/173.7

See application file for complete search history.

(56) References Cited

U.S. PATENT DOCUMENTS

| | | | | |
|---|---|---|---|---|
| 2,918,254 | A * | 12/1959 | Hausammann | F04D 29/2272 415/116 |
| 7,887,297 | B2 * | 2/2011 | Allen-Bradley | F01D 5/145 416/193 A |
| 10,458,248 | B2 * | 10/2019 | Wolfrum | F01D 5/145 |
| 10,753,206 | B2 * | 8/2020 | Brettschneider | F01D 9/041 |
| 2007/0059177 | A1 | 3/2007 | Harvey | |
| 2007/0258817 | A1 * | 11/2007 | Allen-Bradley | F01D 5/143 416/193 A |

(Continued)

FOREIGN PATENT DOCUMENTS

| | | | |
|---|---|---|---|
| DE | 102015224376 | A1 | 6/2017 |
| EP | 2487329 | A1 | 8/2012 |

OTHER PUBLICATIONS

Search Report dated Jun. 11, 2018 for BE 201705764.

*Primary Examiner* — J. Todd Newton

(74) *Attorney, Agent, or Firm* — James E. Walton

(57) ABSTRACT

A low-pressure compressor for an axial-flow turbomachine, such as a jet engine, includes an annular row of vanes and a between-vanes passage with a connecting surface that links the pressure surface of a first vane to the suction surface of a second vane of the row. The connecting surface includes a main protuberance which includes a first elevation and a second elevation that are spaced apart from one another.

10 Claims, 5 Drawing Sheets

(56) References Cited

U.S. PATENT DOCUMENTS

| | | | | |
|---|---|---|---|---|
| 2007/0258818 | A1* | 11/2007 | Allen-Bradley | F01D 5/143<br>416/193 A |
| 2011/0110788 | A1* | 5/2011 | Guimbard | F01D 5/143<br>416/241 R |
| 2012/0201688 | A1* | 8/2012 | Mahle | F01D 5/143<br>416/235 |
| 2013/0136621 | A1 | 5/2013 | Wunderer | |
| 2014/0044551 | A1* | 2/2014 | Mahle | F01D 5/143<br>416/223 R |
| 2017/0159444 | A1* | 6/2017 | Wolfrum | B64D 27/02 |
| 2017/0370234 | A1* | 12/2017 | Brettschneider | F01D 9/041 |

* cited by examiner

SHROUD HAVING ELEVATIONS, FOR A TURBOMACHINE COMPRESSOR

This application claims priority under 35 U.S.C. § 119 to Belgium Patent Application No. 2017/5764, filed 26 Oct. 2017, titled "Shroud Having Elevations, for a Turbomachine Compressor," which is incorporated herein by reference for all purposes.

BACKGROUND

1. Field of the Application

The present application relates to a compressor having a profile between-vanes surface. The present application also deals with an axial-flow turbomachine, in particular a turbine engine for an aeroplane or a turboprop for an aircraft.

2. Description of Related Art

Document US 2007/0059177 A1 discloses a jet engine compressor. The compressor has an annular row of vanes. A platform is associated with each vane and has a three-dimensional relief extending between two successive vanes. Each relief has two elevations that are separated by a sinusoidal channel carved radially into the platform. This geometry improves the aerodynamic efficiency of an axial-flow compressor blading. However, it results in a separation of the flow at the extrados of the vanes.

Although great strides have been made in the area of axial flow turbomachine compressors, many shortcomings remain.

DETAILED DESCRIPTION OF THE PREFERRED EMBODIMENT

Figure 1:
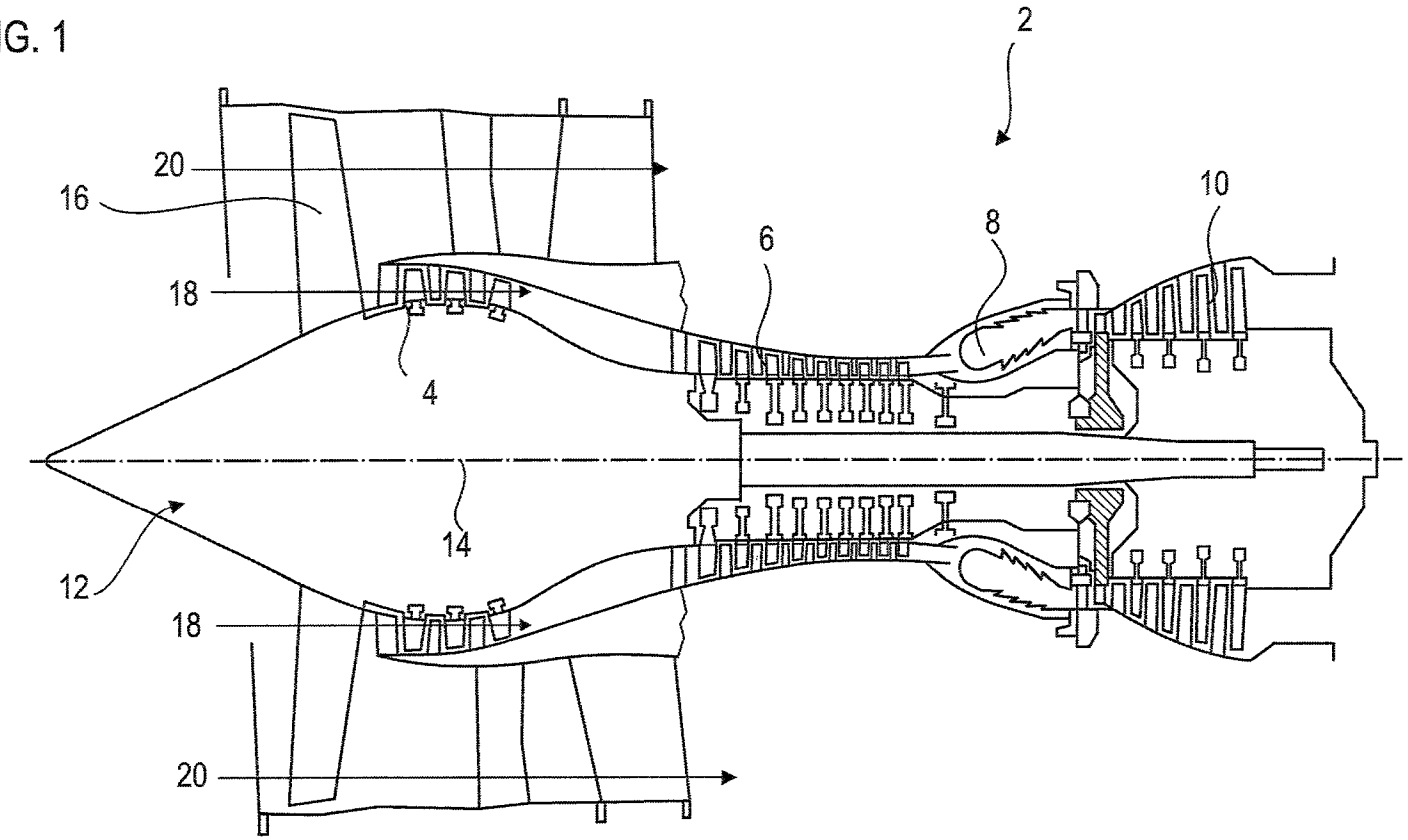
FIG. 1 shows an axial-flow turbomachine according to the invention.

The present application aims to solve at least one of the problems presented by the prior art. More specifically, the invention has the object of optimizing the compression ratio and corner flow separations at the suction surface. The invention also has the object of proposing a solution that is simple, durable, lightweight, economical, reliable, easy to produce, and simple to maintain.

Overall, the invention can be understood as being an elevation having two main peaks—and/or a convex portion having two radial extrema—between two consecutive vanes of a compressor.

The invention relates to an axial-flow turbomachine compressor, in particular a low-pressure compressor of an axial-flow turbomachine, the compressor comprising: a rotor rotating around an axis, a stator comprising an annular row of vanes, each vane comprising a leading edge, a trailing edge, a pressure surface and a suction surface extending from the leading edge to the trailing edge, a between-vanes passage with a connecting surface that links the pressure surface of a first vane to the suction surface of a second vane of the row, noteworthy in that the connecting surface comprises: a main protuberance, the main protuberance comprising a first elevation having a first peak and a second elevation having a second peak; an upstream zone upstream of the protuberance and a downstream zone downstream of the protuberance, said zones each being of constant radius RC; a col that links the first elevation and the second elevation, the col having a curve of shortest length linking the first peak to the second peak, all the points of said curve being radially at a distance to the axis that is greater than the constant radius RC of the upstream and downstream zones.

According to advantageous embodiments of the invention, the compressor may comprise one or more of the following features, taken alone or in any possible technical combination:

The protuberance extends over the majority of the connecting surface.

The first elevation and the second elevation are arranged in an upstream half of the protuberance and/or of the vanes of the row.

The first elevation extends radially further than the second elevation, from the protuberance and/or from the general level of the connecting surface.

The first elevation extends from the pressure surface of the first vane, and may comprise a first peak at a distance from said pressure surface.

The second elevation extends from the suction surface of the second vane, and comprises in particular a second peak immediately adjoining said suction surface.

The connecting surface has an upstream third extending from the leading edges, the first elevation and the second elevation being contained in said upstream third.

The connecting surface comprises four corners defining a median plane, said corners being located at the leading edges and the trailing edges of the vanes, with the protuberance forming a radial increase in material of the connecting surface compared to said median plane, in particular the general plane.

Axially, the length of the first elevation is between 30% and 50%—inclusive—of the length of the first vane.

Circumferentially, the width of the first elevation is between 40% and 60%—inclusive—of the width of the between-vanes passage.

Axially, the length of the second elevation is between 15% and 25%—inclusive—of the length of the second vane.

Circumferentially, the width of the second elevation is between 5% and 15%—inclusive—of the width of the between-vanes passage.

The surface of the second elevation is at most 5% of the surface of the protuberance.

The maximum radial height of the first elevation is greater than or equal to three times the maximum radial height of the second elevation, and/or greater than or equal to ten times the maximum height of the protuberance measured outside the elevations.

The compressor comprises a stator having a shroud, in particular an inner shroud, connected to the annular row of vanes, the connecting surface being formed on said shroud.

The upstream zone and the downstream zone have a constant radius RC over the circumference and over the axis.

The col extends over 40% to 60%—inclusive—of the between-vanes passage.

The first and second peaks are arranged axially at the same position.

Circumferentially, the first elevation is located opposite the second elevation in the between-vanes passage.

The connecting surface, in particular the elevations and the protuberance, is/are in contact with the flow of the compressor.

The maximum radial height of the second elevation is greater than or equal to three times the maximum radial height of the protuberance measured outside the elevations.

With respect to the connecting surface, the protuberance forms an increase in thickness of 0.30 mm.

The protuberance has a downstream half and an upstream half in which the first elevation and the second elevation are contained.

The protuberance crosses the passage and/or connects the vanes in the circumferential direction.

Each vane has a chord whose angle of inclination with respect to the axis of rotation is less than or equal to: 15°, or 30°, or 40°.

The connecting surface is free from hollows, in particular hollows extending over at most: 20%, or 10%, or 5% or 1% of the connecting surface, each hollow being in particular understood as an absence of material when compared to the general plane.

At all points, the connecting surface has a quantity of material that is positive or zero when compared to the general plane.

The passage comprises an upstream axis connecting the leading edges and a downstream axis connecting the trailing edges, which axes constitute the axial limits of the connecting surface.

The first vane and the second vane are vanes that are consecutive and/or adjacent, and/or inclined circumferentially by at most 10° or 5° with respect to one another.

The vanes of the annular row are aligned circumferentially, their leading edges and their trailing edges are aligned circumferentially.

Axially at the trailing edge, the pressure surface and/or the suction surface is parallel to the axis of rotation of the compressor.

Each elevation and/or the protuberance are at an axial distance from the leading edges and the trailing edges.

Each vane comprises a joining radius, with the connecting surface extending from the joining radii of the first vane and of the second vane.

The elevation is convex, in at least two directions, and/or forms a region of increased thickness on the support.

Each vane comprises a chord and a space between its pressure surface and said chord, the first peak being predominantly or entirely within said space, and/or the first elevation being predominantly outside said space.

Perpendicular to the chord, the span of the second elevation is smaller than the span of the vane.

With respect to the general plane, the elevations have inclinations greater than those of the protuberance.

The invention also relates to a turbomachine, in particular an aircraft jet engine, comprising a compressor, this being noteworthy in that the compressor is in accordance with the invention, preferably the row of vanes comprises at least: fifty or eighty vanes.

Overall, each embodiment of the invention can be combined with each item of the invention.

Compression in the passage increases, as does the flow rate passing through it. Under operating conditions of a compressor, the protuberance and the elevations manage the phenomena of turbulence and flow separation. The flow passing through the passage returns to the suction surface during compression, which limits corner flow separation.

In the following description, the terms "inner" and "outer" refer to a position relative to the axis of rotation of an axial-flow turbomachine. The axial direction corresponds to the direction along the axis of rotation of the turbomachine. The radial direction is perpendicular to the axis of rotation. Upstream and downstream refer to the principal flow direction of the flow in the turbomachine.

FIG. 1 is a simplified depiction of an axial-flow turbomachine. This specific case is that of a turbofan engine. The jet engine 2 comprises a low-pressure compressor 4, a high-pressure compressor 6, a combustion chamber 8 and one or more turbine stages 10. In operation, the mechanical power of the turbine 10, transmitted via the central shaft to the rotor 12, moves the two compressors 4 and 6. The latter comprise multiple rows of rotor vanes associated with rows of stator vanes. The rotation of the rotor about its axis of rotation 14 thus makes it possible to generate a flow of air and to progressively compress the latter up to the inlet to the combustion chamber 8.

A fan 16 is coupled to the rotor 12 and generates a flow of air which is split into a core flow 18 and a bypass flow 20 that passes through an annular duct (shown in part). The bypass flow can be accelerated so as to produce a thrust reaction which an aeroplane needs to fly. The core flow 18 and the bypass flow 20 are annular.

Figure 2:
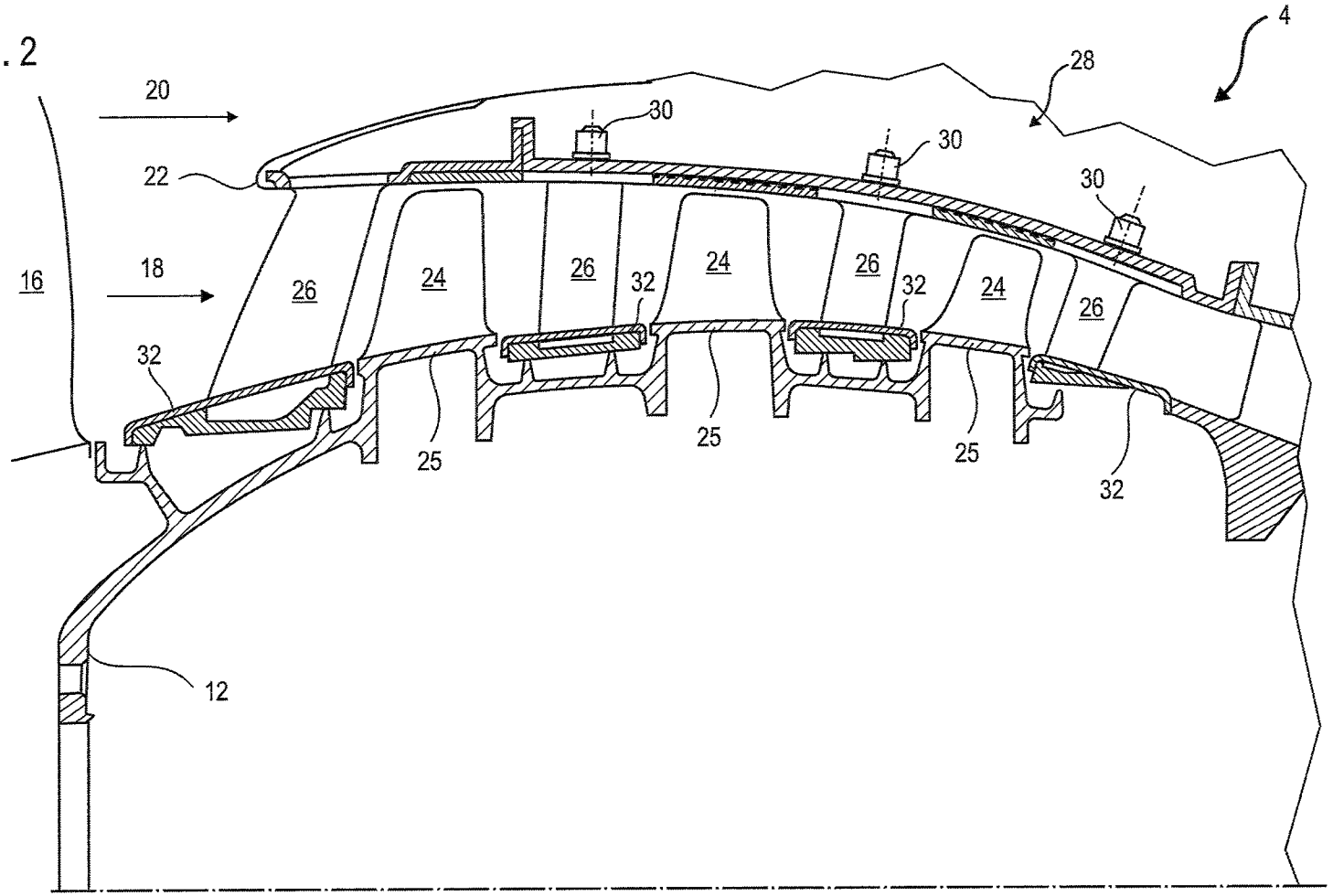
FIG. 2 is a diagram of a turbomachine compressor according to the invention.

FIG. 2 is a section view of a compressor of an axial-flow turbomachine such as that of FIG. 1. The compressor may be a low-pressure compressor 4. The figure shows a portion of the fan 16 and the splitter 22 for separating the core flow 18 from the bypass flow 20.

The rotor 12 comprises multiple rows of rotor vanes 24, in this case three. It may be a bladed drum, or comprise vanes attached by means of a dovetail arrangement. The rotor vanes 24 may extend radially from an individual platform, or from an inner crown 25 of the rotor 12.

The low-pressure compressor 4 comprises multiple stators, in this case four, each of which contains one row of stator vanes 26. The stators are associated with the fan 16 or with a row of rotor vanes in order to redirect the flow of air so as to convert the velocity of the flow into pressure, in particular into static pressure.

The stator vanes 26 extend essentially radially from an outer casing 28. They can be secured and immobilized thereon by means of attachment such as spindles 30. They extend radially through the core flow 18. The stator vanes may have a fixed orientation with respect to the casing 28. Advantageously, the vanes of a single row are identical and aligned. Each row may comprise one hundred and twenty vanes (26; 24).

Inner shrouds 32 may be suspended from the inner ends of the stator vanes 26. The inner shrouds 32 may engage in a leak-proof manner with the rotor 12 in order to improve the compression ratio of the compressor 4.

Figure 3:
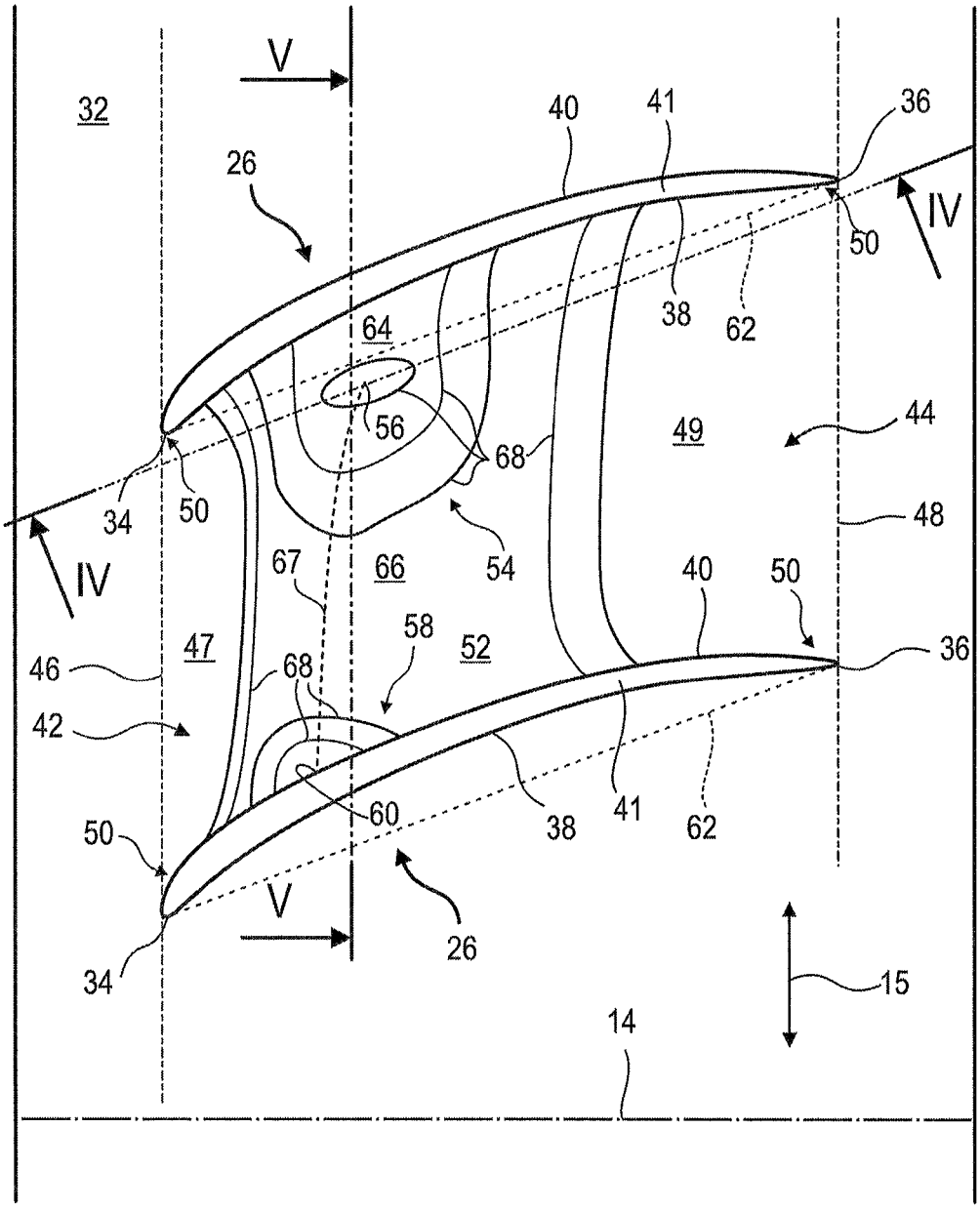
FIG. 3 shows two compressor vanes bounding a connecting surface according to the invention.

FIG. 3 is a diagrammatic depiction of two vanes 26 that are representative of an annular row.

The row may be one of the rows presented in the context of the preceding figures. The vanes and their support, which may be the inner shroud 32, are shown in plan view. The axis of rotation 14 is inscribed in a figurative position and provides a spatial reference.

Each vane 26 comprises a leading edge 34, a trailing edge 36, a pressure surface 38 and a suction surface 40. These surfaces (38; 40) may be, respectively, concave and convex. Each of these surfaces extends from the leading edge 34 to the corresponding trailing edge 36. The vane 26 may comprise a stack of cambered aerodynamic profiles 41, the sides of which generate the pressure surface 38 and the suction surface 40. At the trailing edges 36, the contours of the profiles 41, at the pressure surface and/or at the suction surface, are parallel and/or tangential to the axis of rotation 14 of the compressor.

The consecutive vanes 26 of the annular row define between them a passage 42, which is also referred to as the between-vanes passage 42. This passage 42 is enclosed circumferentially by the vanes 26 and delimited by the pressure and suction surfaces. The passage 42 may have a connecting surface 44 between the two consecutive vanes 26, and may link the pressure surface 38 facing the suction surface 40 via the passage 42.

The connecting surface 44 may be delimited axially by an upstream axis 46 and a downstream axis 48 which respectively connect the leading edges 34 and the trailing edges 36. These axes (46; 48) may be parallel, and may in general define a parallelogram or a trapezium. The connecting surface 44 may be generally planar.

More precisely, the connecting surface 44 may be a portion of a tubular surface or a portion of a conical surface, in particular owing to the radius of the shroud and the optional variation in diameter of the shroud 32 along the axis of rotation 14. It may comprise four corners 50 corresponding to the points where the edges (34; 36) and the support—in this case the shroud 32, which may be an inner shroud—meet.

The connecting surface 44 may comprise an upstream zone 47 extending downstream from the upstream axis 46, and a downstream zone 49 extending upstream from the downstream axis 48.

The connecting surface 44 has axial asymmetry with respect to the axis of rotation 14. It has a protuberance 52, in particular a main protuberance 52. This protuberance 52 may occupy the majority of the connecting surface 44. The axial majority of the protuberance 52 may be contained within the upstream half of the row of vanes 26. It forms a radial addition of material on the connecting surface 44. The addition of material may be observed with regard to zones 47 and 49.

The protuberance 52 also comprises a first elevation 54 having a first peak 56, and a second elevation 58 having a second peak 60. These elevations 54 and 58 may be the main elevations of the protuberance 52, that is to say that they form the main volume reliefs thereof.

The elevations (54; 58) may extend over at most the axial majority of the vanes 26. The first elevation may extend axially over 30% of the chord 62 of the first vane 26, and/or the second elevation 58 may extend axially over 20% of the chord 62 of the second vane 26. These elevations (54; 58) may be axially set back from the leading edges 34, in particular by 10% of the axial length of a chord 62. The first peak 56 may have a main elongation parallel to the chord 62 of the first vane 26.

Along the circumference 15, the first elevation 54 may extend over 50% of the between-vanes passage 42 and may extend from the pressure surface 38. Its peak 56 may be spaced apart from the pressure surface 38. A channel 64 may be formed against the first elevation 54, between the pressure surface 38 of the first vane 26 and the first peak 56. The second elevation 58 may extend circumferentially over 10% of the passage 42, its peak 60 may immediately adjoin the suction surface 40 of the second vane 26.

The first elevation 54 and the second elevation 58 may be at the same axial level. Their peaks (56; 60) may be axially aligned. The elevations (54; 58) may be separated from one another, and in particular circumferentially remote from one another. A col 66, such as a mountain col, may separate them in the circumferential direction.

The curve noted 67 of the col 66 is the curve connecting the peaks 56, 60 that has the shortest length. This curve 67, as well as all the points of the col 66 are raised above the regular radius of the inner shroud as represented by the radius RC of the zones 47 and 49.

The elevations (54; 58) and the protuberance 52 are represented by contour lines 68. These contour lines 68 mark variations in radial level with respect to a reference surface, in this case the connecting surface 44.

Figure 4:
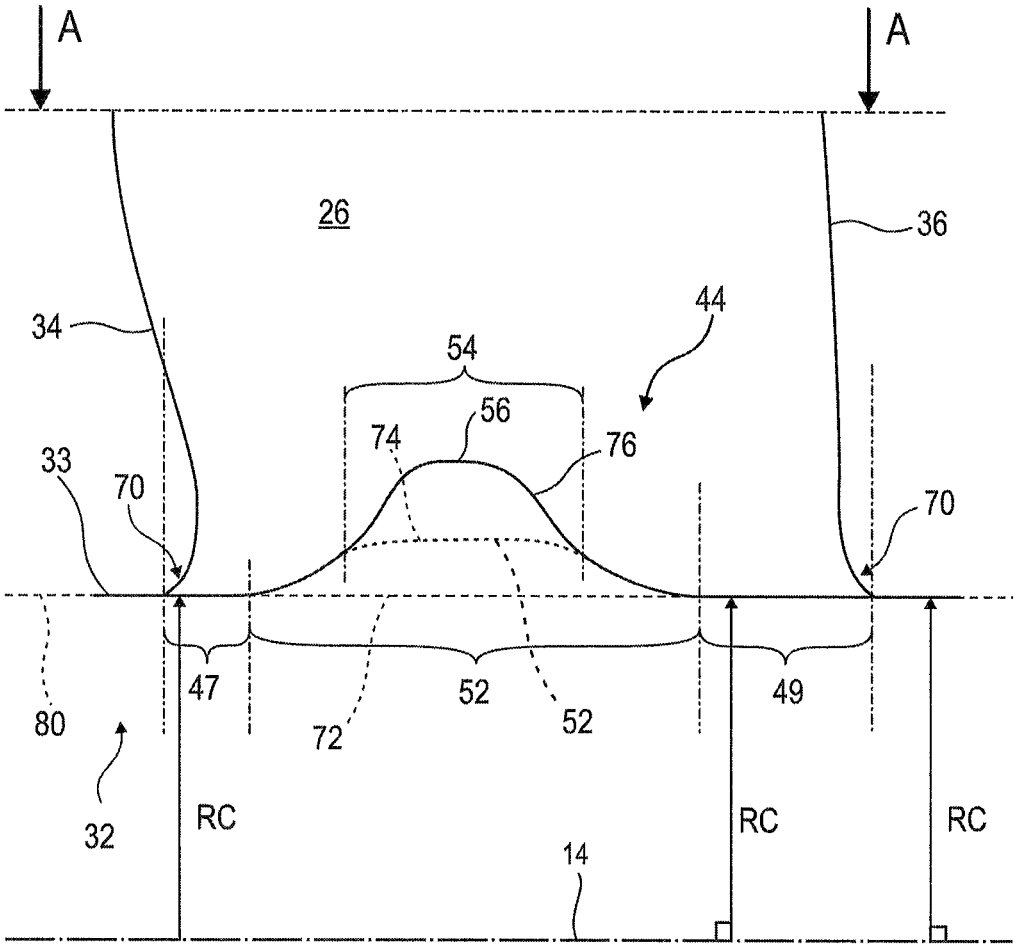
FIG. 4 is a section through FIG. 3, as per the line IV-IV.

FIG. 4 is a section through FIG. 3, as per the line IV-IV. Both the position and the inclination of the axis of rotation 14 are figurative and may vary in concrete embodiments.

In general, the vanes may comprise joining radii 70 at their radial ends. The joining radii 70 may surround their respective vane 26. The connecting surface 44 may extend from the joining radii 70 so as to connect them in pairs. The radial thickness of the joining radii 70 is smaller than that of the elevations and possibly of the protuberance 52.

The leading edge 34 and the trailing edge 36 of the first vane extending radially from the annular surface 33 of the inner shroud 32. This annular surface 33 may have a constant radius RC outside the passages. The annular surface 33 may have axial symmetry. The zones 47 and 49 may extend the annular surface 33 and be axially tangential thereto. They may have arcs of constant radius RC over the circumference.

A first dotted line 72 extends and connects the zones 47 and 49. A second dotted line 74 illustrates the general profile of the protuberance 52. The radial distance between these dotted lines (72; 74) illustrates the additional material, that is to say the radial extension formed by the protuberance 52 on the connecting surface 44. Similarly, the solid line 76 which is spaced apart from the second dotted line 74 illustrates the radial extension formed by the first elevation 54 on the protuberance 52, that is to say the local thickening of the connecting surface 44. The solid line 76 may pass through the first peak 56. This peak may be flat.

The radial thickness proper of the first elevation 54 may be two times greater than the thickness proper of the protuberance 52. These thicknesses may be maximum thicknesses.

With respect to the general plane 80 of the connecting surface 44, the elevations (54; 58) have inclinations greater than those of the protuberance 52. The general plane 80 may join at least one or multiple or every corner of the connecting surface 44. Upstream and downstream, the protuberance 52 has slopes that are shallower than the adjacent slopes of the elevations.

The present teaching may also be applied to an outer shroud or to a casing via symmetry with respect to the axis A-A.

Figure 5:
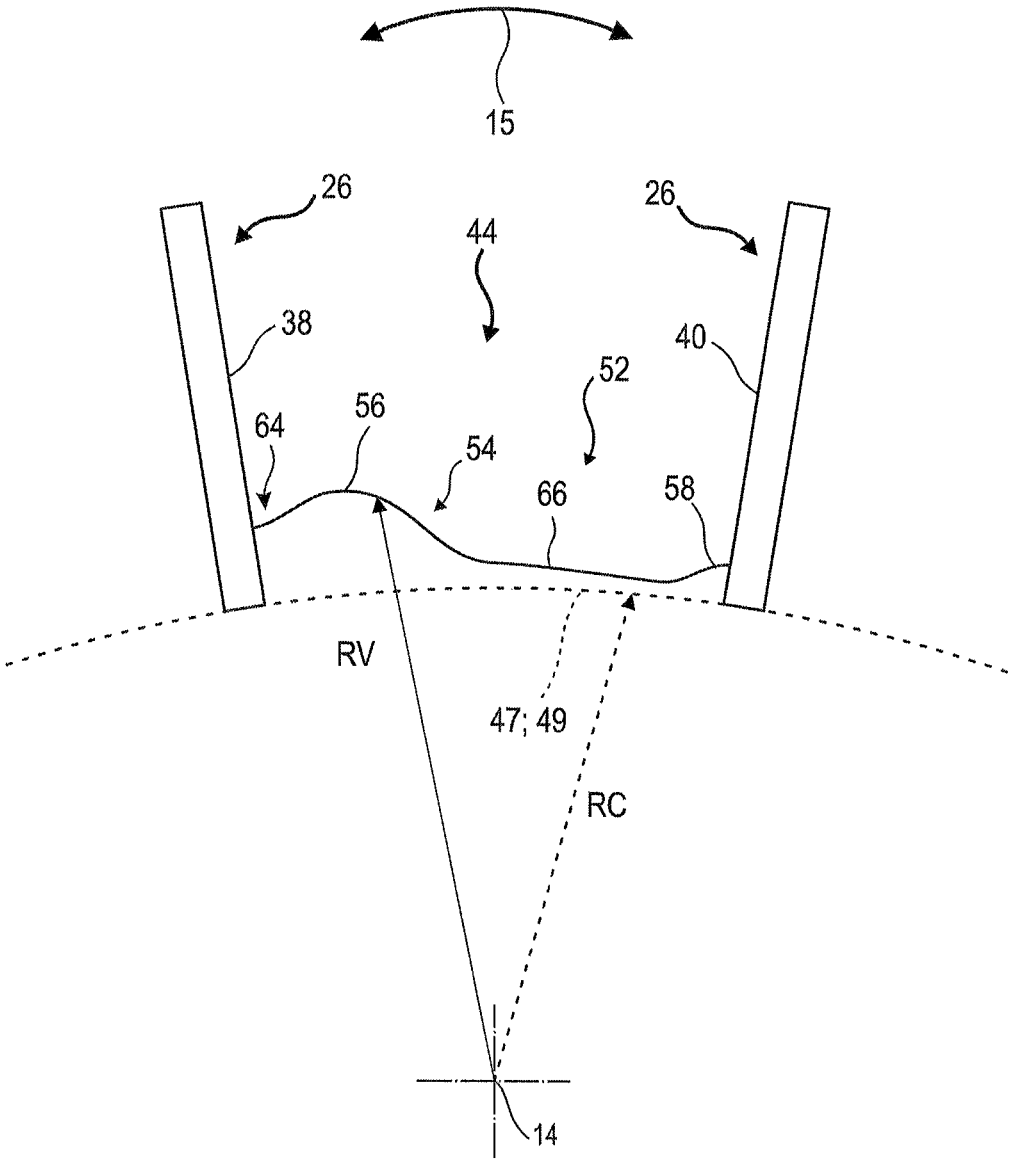
FIG. 5 is a section through FIG. 3, as per the line V-V.

FIG. 5 is a section through FIG. 3, as per the line V-V. The section is perpendicular to the axis of rotation 14, and passes through both the elevations (54; 58) and the protuberance 52.

About the axis of rotation 14, the connecting surface 44 is of constant radius RC. This constant radius RC may correspond to that of the first zone 47 and/or to that of the second zone 49. At the elevations (54; 58), it is of variable radius RV. The first peak 56 of the first elevation 54 is arranged between the col 66 and the channel 64.

The connecting surface 44 is profiled. It has a radial increase in material compared to its base, generated in particular by the zones (47; 49). At a given point of the axis of rotation 14 located at the level of the elevations, the radius RV of the connecting surface 44 may vary when it crosses the connecting surface 44 in the circumferential direction 15, in particular when moving from one vane 26 to the adjacent vane, that is to say between the pressure surface 38 and the suction surface 40.

Although only two vanes are shown, the present teaching may apply to all of their annular row, or to multiple vanes, or to every annular row of stator vanes of the compressor. Similarly, the connecting surface may be reproduced in identical fashion between each adjacent vane of a single row. This may form multiple annular rows of elevations (54; 58) that are identical, and multiple annular rows of protuberances 52 that are identical.

The teaching of each figure may be combined independently with the teaching of each of the other figures. The invention provides for a combination of the teaching of all of the figures and/or with a combination of the entirety of the technical solution.

I claim:

1. Axial-flow turbomachine compressor, comprising:

a rotor rotating around an axis;

a stator having an annular row of vanes, each vane comprising:

a leading edge;

a trailing edge;

a pressure surface; and a suction surface extending from the leading edge to the trailing edge; and a between-vanes passage with a connecting surface that links the pressure surface of a first vane to the suction surface of a second vane of the row, the connecting surface being delimited by four corners located at the leading edges and the trailing edges of the first and second vanes;

wherein the connecting surface consists of:

a main protuberance, the main protuberance comprising:

a first elevation having a first peak; and a second elevation having a second peak;

an upstream zone arranged upstream of the main protuberance and a downstream zone arranged downstream of the main protuberance, said upstream and downstream zones each being of constant radius RC from the axis;

wherein the main protuberance forms one radial increase in material extending from the pressure surface of the first vane to the suction surface of the second vane such that all the points of a curve of shortest length linking the first peak to the second peak are radially at a distance to the axis that is greater than the constant radius RC of the upstream and downstream zones.

2. The compressor according to claim 1, wherein the second elevation extends from the suction surface of the second vane and the second peak is immediately adjoining said suction surface.

3. The compressor according to claim 1, wherein the first elevation and the second elevation are arranged in an upstream half of the main protuberance and in an upstream half of the first and second vanes of the row of vanes.

4. The compressor according to claim 1, wherein the first elevation extends radially further than the second elevation.

5. The compressor according to claim 1, wherein the first elevation extends from the pressure surface of the first vane.

6. The compressor according to claim 1, wherein the first elevation and the second elevation are closer to the leading edge than to the trailing edge of each vane.

7. The compressor according to claim 1, wherein the maximum radial height of the first elevation is greater than or equal to three times the maximum radial height of the second elevation.

8. The compressor according to claim 1, wherein the stator comprises:

an inner shroud connected to the annular row of vanes, the connecting surface being formed on said inner shroud.

9. The compressor according to claim 1, wherein the first and second peaks have the same axial position.

10. The compressor according to claim 1, wherein, in the between-vanes passage, the first elevation is opposite the second elevation in the circumferential direction.

* * * * *